US007111433B2

(12) United States Patent
Kerscher

(10) Patent No.: US 7,111,433 B2
(45) Date of Patent: Sep. 26, 2006

(54) COVERS FOR DOOR JAMBS AND MULLIONS

(75) Inventor: Lawrence Frank Kerscher, De Pere, WI (US)

(73) Assignee: Bay Industries, Inc., Green Bay, WI (US)

( * ) Notice: Subject to any disclaimer, the term of this patent is extended or adjusted under 35 U.S.C. 154(b) by 364 days.

(21) Appl. No.: 10/109,759

(22) Filed: Mar. 28, 2002

(65) Prior Publication Data

US 2003/0145538 A1 Aug. 7, 2003

Related U.S. Application Data

(60) Provisional application No. 60/355,592, filed on Feb. 7, 2002.

(51) Int. Cl.
*E06B 1/04* (2006.01)

(52) U.S. Cl. ..... 52/212; 52/211; 52/656.4; 49/504

(58) Field of Classification Search ..... 52/210–213, 52/217, 656.4; 49/504
See application file for complete search history.

(56) References Cited

U.S. PATENT DOCUMENTS 2,755,895 A 7/1956 Walterman et al.
3,103,263 A * 9/1963 Leeser
3,591,985 A 7/1971 Coppins
3,774,345 A 11/1973 Cole et al.
3,783,559 A 1/1974 Yocum et al.
4,236,354 A 12/1980 Passovoy (Continued)

OTHER PUBLICATIONS

Photocopy of a cross-section of a door jamb assembly which is believed to be publicly known. Such door jamb may have been manufactured by the Wausau Supply Company, of Wausau Wisconsin.

(Continued)

*Primary Examiner*—Carl D. Friedman
*Assistant Examiner*—Yvonne M. Horton
(74) *Attorney, Agent, or Firm*—Wilhelm Law Service; Thomas D. Wilhelm

(57) ABSTRACT

Metal cladding as jamb cover assemblies and mullion cover assemblies, for door frames and mullions, using extrusions as cladding over substrates. A jamb cover assembly includes a jamb plate, a nosing, and a nailing fin. The nailing fin extends from a distal side of the assembly. Accordingly, the frame can be secured in a rough opening of a building with the nosing assembled to the jamb plate, and using the nailing fin for the securement, without any assembly or disassembly of the frame at the construction site. Regarding the mullion cover assembly, first and second jamb plates are on opposing sides of a mullion substrate. A mullion nosing is assembled to the jamb plates, and bridges the jamb plates to join together the two jamb plates and the nosing, to provide complete overlayment of the outer surface of the mullion substrate and to space the front panel of the nosing from the outer surface of the substrate.

31 Claims, 3 Drawing Sheets

U.S. PATENT DOCUMENTS 4,281,480 A 8/1981 Wendt
4,308,692 A 1/1982 Rumble et al.
4,509,294 A 4/1985 Boilard
4,531,337 A 7/1985 Holdiman
4,821,472 A 4/1989 Tix
4,999,957 A 3/1991 Kessler
5,070,651 A * 12/1991 Jeter ..... 49/504
5,072,547 A 12/1991 DiFazio
5,375,383 A 12/1994 Lin et al.
5,437,130 A 8/1995 Raynak
5,572,840 A 11/1996 Fast et al.
5,758,458 A * 6/1998 Ridge ..... 52/204.1
6,293,061 B1 * 9/2001 Hoeak, Jr. ..... 52/213
6,343,438 B1 2/2002 Boldt
6,405,506 B1 * 6/2002 Ruff ..... 52/656.4

OTHER PUBLICATIONS

Author Unknown; Title unknown. Photocopy of what appears to be a catalog page from Wausau Supply Co received from Dusty Dvorak. Publication information unknown.
Photocopy of cross section of FLB27.
Photocopy of cross section of FLB273.
Wausau Supply Profile Sheet.

* cited by examiner

COVERS FOR DOOR JAMBS AND MULLIONS

This application claims the benefit of Provisional application Ser. No. 60/355,592, filed Feb. 7, 2002.

BACKGROUND

This invention pertains specifically to prefabricated and otherwise cladded metal door frames and mullions, using extrusions as cladding over frame substrate elements.

When installing a door frame into a door opening in a building, it is desirable to have a strong, durable frame which is either prefabricated or easily assembled on the construction site. Preferably, the frame can be assembled at an off-site manufacturing location. In the alternative, it is desirable to have frame elements which are easily assembled at the construction site.

In a typical construction project involving doors, door frames or mullions are fabricated by a frame or mullion fabricator, and shipped to a door assembler. The door assembler receives the frames and/or mullions as fabricated, and assembles e.g. the frames to respective door slabs. The slabs are also commonly purchased separately, from slab manufacturers. The door assembler adds the desired glass inset, if any, to the door slab, assembles the door slab to a selected door frame, and ships the thus assembled door, including frame and slab, to the construction site for installation on the building.

Typically, the basic frame is wood. The door assembler can easily up-grade the quality and value of the frame, and thus the quality and value of the door assembly, by installing cladding to the left, right, and top frame substrate members, thus to provide maintenance free, tough, and durable exterior surfaces to the frame.

In one set of known clad structures, a single extrusion is mounted to the substrate, providing covering on both the side surface of the substrate and over the outer surface of the substrate. Such extrusion typically provides interface structure on opposing surfaces of the substrate, whereby each extrusion is limited to the size of substrate with which such extrusion can be used.

In the alternative, a jamb plate cover is provided along a side surface of the substrate, but does not extend over the outer surface of the substrate. A separate nosing grips the jamb plate on a first surface of the substrate and grips the opposing surface of the substrate.

In an improvement in versatility of the cladding, over such structures, it is known to provide a jamb plate which has a main side panel which covers the side surface of the substrate and an outer panel which extends over the outer surface of the substrate. A nosing, such as in a brick mold profile or a window trim profile, is mounted to, and extends over, the outer panel of the jamb plate. The outer edge of the outer panel is coincident with the distal side of the nosing. The outer panel of the jamb plate is used to mount the cladding, and thus the door frame, to framing members of the building, by e.g. screws or other fasteners extending through the outer panel of the jamb plate. Accordingly, the nosing cannot be mounted on the jamb plate while the door frame is being mounted to the building.

Such configuration requires that the nosing be assembled to the jamb plate after the door frame is inserted into the rough opening and mounted to the building. By corollary, the nosing can be shipped to the construction site assembled to the jamb plates, whereupon the nosing must be disassembled from the jamb plates before the door frame can be installed on the building, and then reassembled to the door frame after the door frame has been installed. While such process provides for shipping of the nosing in an assembled configuration, disassembly at the construction site is required.

In an alternative process, the door frame is shipped to the job site without the nosing assembled to the frame. The nosing is shipped separately, though typically in the same shipment. This process saves the disassembly step at the construction site. However, the separate shipment of the nosing bears a risk of the nosing being mishandled, separated from the door frame, and lost, whereupon the installation job can be completed only by shipping an additional nosing to the job site. Another risk inherent in the above process is that a different style nosing will be shipped with the door frame, or that a different style nosing will be shipped as a replacement.

Thus, it is an object of the invention to provide a cladded door frame, including a jamb cover assembly on respective frame substrates, wherein the jamb cover assembly includes a jamb plate, a nosing, and a nailing fin, and wherein the nailing fin is so positioned with respect to the nosing that the door frame can be mounted and secured in a rough opening of a building while the jamb cover assembly is fully assembled to the respective frame substrates.

It is another objective to provide an elongate jamb plate wherein an outer panel, which overlies the outer surface of the respective jamb substrate, and which bears mounting structure for receiving a nosing thereon, is devoid of structure, outwardly of the mounting structure, for mounting the jamb plate to a framing member of a building to which the frame is to be mounted.

It is another object to provide a nosing for mounting on a jamb plate, wherein a nailing fin kerf is disposed on the nosing proximate a distal side of the nosing.

It is another object of the invention to provide, in combination, a jamb plate cooperating with a nosing wherein a mounting fin kerf is disposed in a region from proximate a distal side of the nosing to proximate a mounting structure on the jamb plate mounting the nosing and the jamb plate to each other.

Yet another object is to provide a pre-assembled door frame wherein a jamb cover assembly, comprising a jamb plate and a nosing, is mounted to one or more jamb substrates wherein a mounting fin extends outwardly beyond a distal side of the nosing thereby to enable mounting the jamb cover assembly to a framing member of a building while the nosing is mounted to the jamb plate.

Mullions can be up-graded in much the same manner of adding cladding to mullion substrates.

Accordingly, it is an object of the invention to provide a cladded mullion assembly wherein a mullion nosing is mounted to both first and second jamb plates, the jamb plates being mounted on opposing sides of the mullion substrate, and extending over the outer surface of the mullion substrate, and wherein the nosing is mounted to both of the jamb plates proximate the outer surface of the mullion substrate and thus bridges the jamb plates while covering the entire outer surface of the mullion substrate.

Still another objective is to provide a method of installing a door frame in a door opening in a building, including assembling the door frame assembly at an off-site location, transporting the door frame to the building site, and installing the frame in the building, including securing the mounting fin to building framing members while a respective nosing is installed on a respective jamb plate.

SUMMARY

The invention generally comprises aluminum cladding as jamb cover assemblies and mullion cover assemblies, for door frames and mullions, using extruded aluminum profiles as cladding over wood frame substrate members. A respective jamb cover assembly includes a jamb plate, a nosing, and a nailing fin. The nailing fin is positioned in the cover assembly such that the nailing fin extends outwardly from a distal side of the jamb cover assembly when the nosing is assembled to the jamb plate. Accordingly, the frame can be secured in a rough opening of a building with the nosing assembled to the jamb plate.

With the nailing fin extending outwardly from the fully assembled jamb cover assembly, namely with the nosing assembled to the jamb plate, the so-clad door frame can be assembled into the rough opening in the building, and secured to the building, using the nailing fin, without any assembly or disassembly of the frame or any of the cover assembly elements at the construction site.

Regarding the mullion cover assembly, first and second jamb plates are positioned on opposing sides of a mullion substrate. A mullion nosing is assembled to mounting structure at the outer panels of the jamb plates, and bridging the jamb plates so as to join together the two jamb plates and the nosing, thus to provide complete overlayment of the outer surface of the mullion substrate and to space the front panel of the nosing from the outer surface of the mullion substrate.

A first expression of the invention is embodied in an elongate jamb plate for mounting on an elongate jamb substrate of a door frame. The jamb plate comprises a main side panel for covering at least a major portion of a side surface of the jamb substrate, along at least a major portion of a length of the jamb substrate; and an outer panel for extending along at least a major portion of the length of the jamb substrate, and configured to extend at an angle transverse to the main side panel, and away from the main side panel and over an outer surface of the jamb substrate, the outer panel bearing mounting structure adapted to mount the outer panel to an elongate nosing. The outer panel is preferably devoid of structure outwardly of the mounting structure for mounting the jamb plate to a framing member of a building to which the door frame is to be mounted.

In some embodiments, the mounting structure comprises first and second spaced legs, extending outwardly from the outer panel, and including locking structure for assisting in locking the nosing to the jamb plate.

In some embodiments, the extension of the outer panel, away from the main side panel, ends proximate an outermost one of the legs.

In preferred embodiments, the jamb plate comprises an aluminum extrusion having nominal profile thicknesses of about 0.06 inch.

A second expression of the invention comprehends an elongate nosing for mounting to an elongate jamb plate, wherein the jamb plate is designed and configured to be mounted on an elongate jamb substrate of a door frame, wherein the jamb plate comprises a main side panel for covering at least a major portion of a side surface of the jamb substrate, along at least a major portion of a length of the jamb substrate, and wherein the jamb plate further comprises an outer panel for extending along a least a major portion of the length of the jamb substrate. The outer panel is configured to extend at an angle transverse to the main side panel, and away from the main side panel and over the outer surface of the jamb substrate, the outer panel bearing a first mounting structure. In such environment, the elongate nosing comprises a second mounting structure, designed and configured to cooperatively mount to the first mounting structure of the jamb plate, thereby to mount the nosing to the jamb plate. The nosing, when mounted to the jamb plate, extends away from the main side panel of the jamb plate to a distal side of the nosing, the nosing comprising a mounting fin kerf proximate the distal side of the nosing and away from the main side panel of the jamb plate.

In preferred embodiments, the nosing comprises first and second spaced legs, connected at spaced locations of the legs to a front panel of the nosing, the second mounting structure being disposed on the legs.

In preferred embodiments, a mounting fin, preferably a polymeric mounting fin, is disposed in the mounting fin kerf.

In highly preferred embodiments, the polymeric mounting fin is deflectable toward the main side panel of the jamb plate, and into proximity with a jamb substrate when the nosing is mounted to a jamb plate which is mounted to a jamb substrate.

Preferably, the nosing comprises an aluminum extrusion having nominal profile thicknesses of about 0.06 inch.

Another expression of the invention comprehends, in combination, an elongate jamb plate, and an elongate nosing for mounting to the elongate jamb plate. The elongate jamb plate comprises a main side panel for covering at least a major portion of a side surface of a jamb substrate, along at least a major portion of a length of the jamb substrate, and an outer panel extending along at least a major portion of the length of the jamb substrate, and extending at an angle transverse to the main side panel, and extending away from the main side panel and over the outer surface of the jamb substrate, the outer panel comprising a first mounting structure. The elongate nosing comprises a second mounting structure, designed and configured to cooperatively engage the first mounting structure of the jamb plate, thereby to mount the nosing and the jamb plate to each other. The nosing, when so mounted to the jamb plate, extends in a direction away from the main side panel of the jamb plate to a distal side of the nosing. The combination of the jamb plate and the nosing, when so mounted to each other, comprises a mounting fin kerf in a region from proximate the distal side of the nosing to proximate the first mounting structure.

The mounting fin kerf can be disposed on either the nosing or the outer panel of the jamb plate.

The combination preferably includes a mounting fin in the mounting fin kerf and extending outwardly beyond the distal side of the nosing and away from the main side panel of the jamb plate.

The first mounting structure preferably comprises first and second studs extending from the outer panel of the jamb plate.

The nosing preferably comprises first and second spaced legs, connected at spaced locations of the legs to a front panel of the nosing, the second mounting structure being disposed on the legs.

Preferably, the mounting structure on the nosing can snap lock to the mounting structure on the outer panel of the jamb plate, preferably to studs on the outer panel of the jamb plate.

A mounting fin is preferably mounted in the mounting fin kerf, the mounting fin preferably comprising a polymeric fin mounted in the combination of the jamb plate and the nosing at the mounting fin kerf.

The mounting fin is preferably deflectable toward the main side panel of the jamb plate, and into proximity with the jamb substrate when the elongate nosing is mounted to the jamb plate and the jamb plate is mounted to a jamb substrate.

Both the jamb plate and the nosing are preferably made from aluminum extrusions having nominal profile thicknesses of about 0.06 inch.

In some embodiments, the invention comprehends a pre-assembled door frame for assembly into a building at an opening in the building. The pre-assembled door frame comprises an elongate jamb substrate having a length, an outer surface for facing outwardly away from the building when the door frame is assembled to the building, and a side surface for facing across the opening whereat the door frame is assembled to such building; and a jamb cover assembly on the elongate jamb substrate. The jamb cover assembly comprises an elongate jamb plate comprising a main side panel covering at least a major portion of the side surface of the substrate, along at least a major portion of the length of the substrate, and an outer panel extending along at least a major portion of the length of the substrate, and extending at an angle transverse to the main side panel, and extending away from the main side panel and over the outer surface of the jamb substrate, the outer panel comprising a first mounting structure, and an elongate nosing comprising a second mounting structure, engaged with the first mounting structure on the outer panel of the jamb plate and thereby mounting the nosing and the jamb plate to each other, the nosing extending in a direction away from the main side panel to a distal side of the nosing. The jamb cover assembly comprises a mounting fin extending outwardly beyond the distal side of the nosing and in a direction away from the main side panel of the jamb plate, the mounting fin being sized and configured thereby to enable mounting the jamb cover assembly to a framing member of the building at an outwardly-facing surface of the framing member while the nosing is mounted to the jamb plate.

The invention typically comprehends a mounting fin kerf on one of the nosing and the jamb plate, optionally proximate the distal side of the nosing, the mounting fin being received in the mounting fin kerf.

The nosing optionally comprises first and second spaced legs, connected at spaced locations of the legs to a front panel of the nosing, the mounting structure of the nosing being disposed on said legs.

Preferably the mounting structure on the nosing snap locks to the mounting structure on the outer panel of the jamb plate, preferably to studs on the outer panel of the jamb plate.

In preferred embodiments, the outer panel of the jamb plate is in surface-to-surface relationship with the outer surface of the jamb substrate.

In preferred embodiments, the mounting fin is deflectable so as to be folded against the jamb substrate.

In some embodiments, the invention comprehends a cladded mullion assembly. The mullion assembly comprises a mullion substrate having a length, first and second opposing side surfaces facing in opposing directions, generally along an outer surface of a building when the cladded mullion assembly is installed on such building, and an outer surface facing outwardly from the building when the cladded mullion assembly is installed on the building; a first elongate jamb plate comprising a first main side panel extending along at least a major portion of the first side surface of the mullion substrate, along at least a major portion of the length of the mullion substrate. The first elongate jamb plate further comprises a first outer panel extending along at least a major portion of the length of the mullion substrate, and extending at an angle transverse to the first main side panel, and extending away from the first main side panel and over the outer surface of the mullion substrate, the first outer panel comprising a first mounting structure; a second elongate jamb plate comprising a second main side panel extending along at least a major portion of the second side surface of the mullion substrate, along at least a major portion of the length of the mullion substrate, the second elongate jamb plate further comprising a second outer panel extending along at least a major portion of the length of the mullion substrate, and extending at an angle transverse to the second main side panel, and extending away from the second main side panel and over the outer surface of the mullion substrate toward the first outer panel of the first jamb plate, the second outer panel comprising a second mounting structure; and an elongate nosing comprising a third mounting structure engaged with the first and second mounting structures on the first and second jamb plates and thereby mounting the nosing to the first and second jamb plates such that the nosing bridges the jamb plates, thereby locking together the combination of the nosing and the first and second jamb plates proximate the outer surface of the mullion substrate.

Typically, the nosing comprises a front panel spaced from the outer panels of the first and second jamb plates.

Preferably, the jamb plates and the nosing comprise aluminum extrusions, preferably aluminum extrusions having nominal profile thicknesses of about 0.06 inch.

Preferably, the first and second outer panels of the respective first and second jamb plates are in surface-to-surface relationship with the outer surface of the mullion substrate.

The invention also comprehends a method of installing a door frame in a door opening in a building. The method comprises, at an off-site location, assembling the door frame, comprising assembling together left, right, and top frame substrate members, each having a side surface facing inwardly of the opening in the building when installed in the building and an outer surface facing outwardly away from the building when installed in the building, thereby to make a door frame precursor having left, right, and top frame elements; installing, on the substrate members, elongate jamb plates wherein each jamb plate comprises a main side panel covering at least a major portion of the side surface of the respective substrate member, and an outer panel extending along a major portion of the outer surface of the respective substrate member; mounting nosings on the outer panels of the jamb plates; and at at least one of the left, right, and top frame elements, assembling a mounting fin to one of the respective jamb plate and the respective nosing, the mounting fin extending outwardly away from the main side surface and away from both the nosing and the jamb plate.

The method further comprises transporting the so-assembled door frame to the building site; and installing the so-assembled door frame to the building, including securing the mounting fin to a building frame member while the respective nosing is installed on the respective frame plate.

In preferred embodiments, the method includes assembling a mounting fin to each of the left, right, and top frame elements such that the respective mounting fins extend outwardly, away from the main side panels of the jamb plates and generally in directions consistent with the outer panels of the jamb plates when the door frame is assembled to the building.

Figure 1:
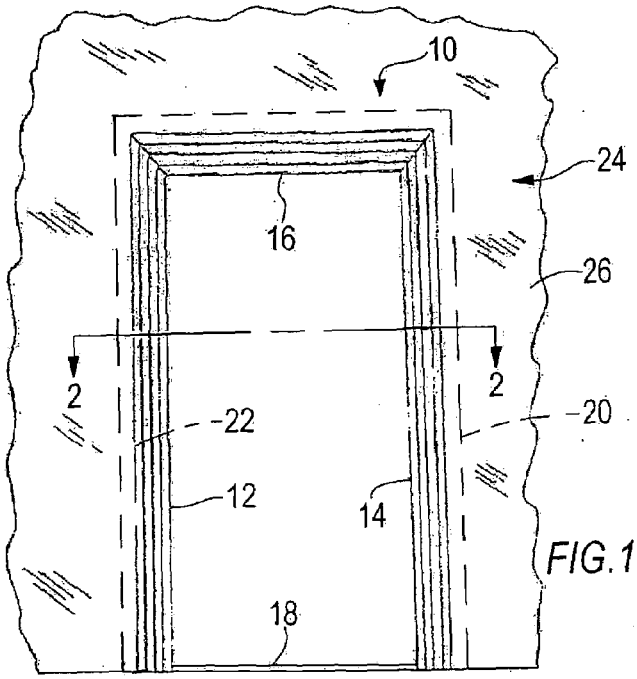
FIG. 1 shows a front elevation view of a door frame of the invention.

The invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DESCRIPTION OF THE ILLUSTRATED EMBODIMENTS

Figure 2:
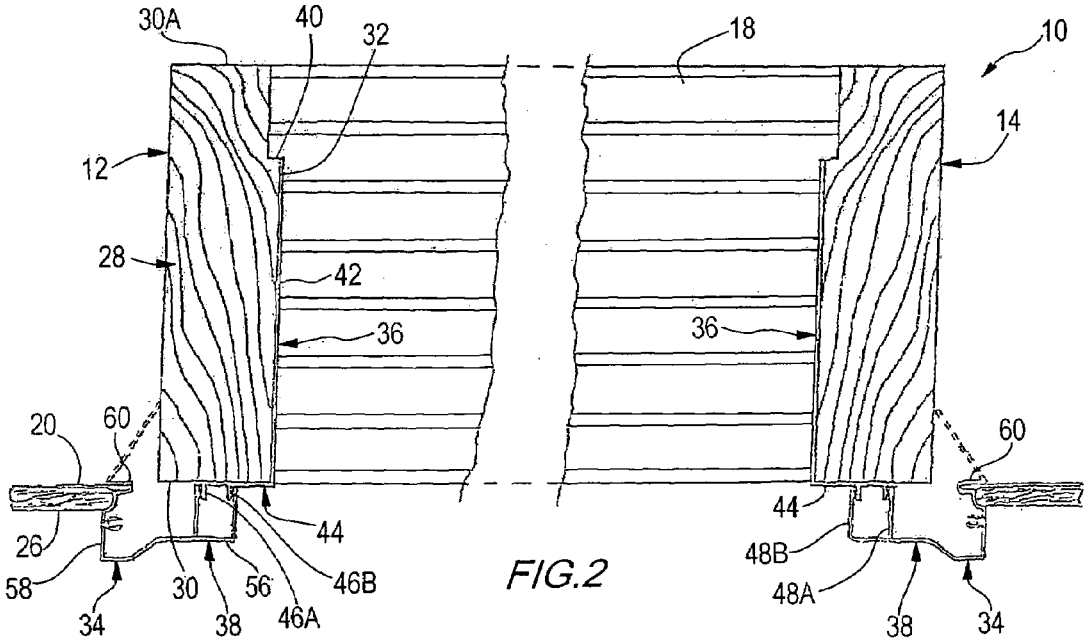
FIG. 2 shows an enlarged cross-section of the door frame of FIG. 1, taken at 2—2 of FIG. 1.

Referring now to the drawings, FIGS. 1 and 2 show a pre-assembled door frame 10 of the invention, The door frame includes a left frame element 12, a right frame element 14, a top frame element 16, and a sill 18, as well as a nailing fin 20 mounted to each of the left, right, and top frame elements. The door frame as shown in FIG. 1 has been inserted into a rough opening 22 in a building 24. As illustrated in FIGS. 1 and 2, a layer of sheet material 26 such as sheathing or siding has been installed over the nailing fin.

Figure 3:
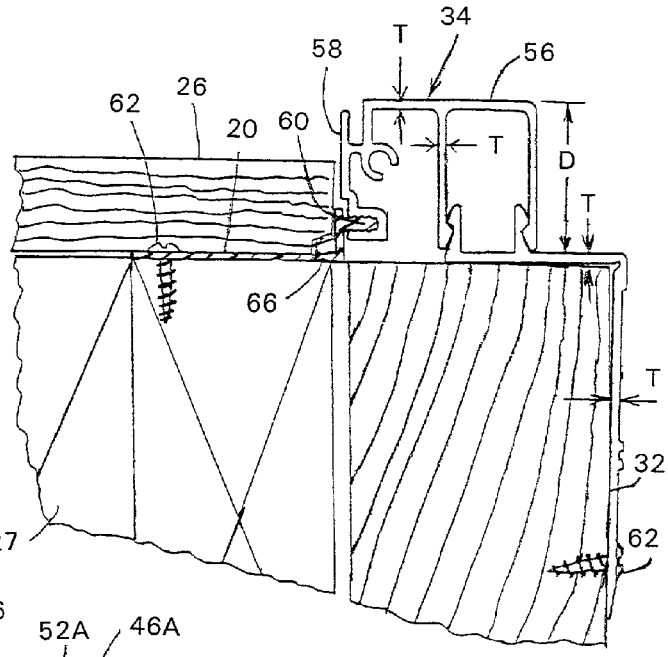
FIG. 3 shows a fragmentary cross-section of a jamb cover assembly of the invention having a medium-width nosing, and mounted on a door jamb.
Figure 4:
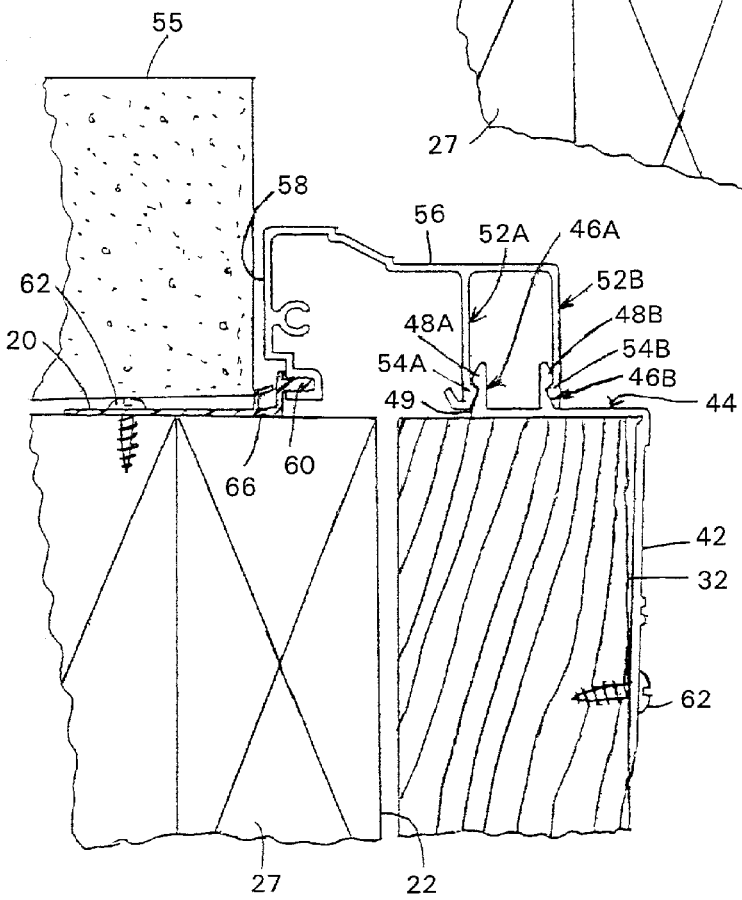
FIG. 4 shows a fragmentary cross-section of a jamb cover assembly of the invention having a brick-mold nosing, and mounted on a door jamb.

Referring to FIG. 2, the left, right, and top frame elements all have substantially the same structure, so only one will be described. Framing members 27 of the building are not shown in FIG. 2 in order to focus attention on the jamb cover assemblies of the invention. Those skilled in the art will know the typical locations of the building framing members, which are shown in FIGS. 3 and 4. Referring to the left frame element in FIG. 2, an elongate wood jamb substrate element 28 extends the full length of the left frame element and serves as a substrate for the left frame element. Substrate 28 has a length, an outer surface 30 facing outwardly away from the building, an opposing outer surface 30A (FIG. 2) facing inwardly into the building, and a side surface 32 facing across opening 22 in the building.

A jamb cover assembly 34 is mounted to the elongate wood substrate. The jamb cover assembly includes an elongate jamb plate 36, a nosing 38, and a respective nailing fin 20. Jamb plate 36 includes a main side panel 42 covering at least a major portion of the side surface 32 of the substrate, along at least a major portion of the length of the substrate. In preferred embodiments, as in FIGS. 1 and 2, the main side panel covers substantially the entirety of the substrate side surface from the outer surface 30 of the substrate to the door seat 40.

Jamb plate 36 further includes an outer panel 44 covering at least a substantial portion, optionally a major portion, of the outer surface 30 of the substrate, along at least a major portion of the length of the substrate. In preferred embodiments, as in FIGS. 1 and 2, the outer panel extends along substantially the entire length of the substrate outer surface. As seen in FIG. 2, the outer surface of the jamb plate is attached to main side panel 42 and extends at a perpendicular, or nearly perpendicular, angle transverse to the main side panel, and extends away from the main side panel and over the outer surface of the jamb substrate. In the embodiment illustrated, the outer panel of the jamb plate is in general surface-to-surface relationship, optionally surface-to-surface contact, with the outer surface of the substrate.

Referring more particularly to FIGS. 3 and 4, the outer panel further includes first mounting structure in the form of first and second studs 46A and 46B which have snap locks 48A and 48B, as locking loci, proximate the ends of the respective studs and proximate outer iamb surface 30 and not proximate outer iamb surface 30A. As illustrated in FIGS. 3 and 4, cross-sections of studs 46A and 46B can be substantial mirror images of each other. Outer panel 44 extends to a distal edge 49 proximate the outermost leg 46A.

Nosing 38 is shown in FIG. 2 as a cross-sectional outline commonly recognized as a "brick mold" in the building trades. Nosing 38 includes second mounting structure in the form of first and second legs 52A and 52B which extend in a common direction toward the first mounting structure, and which accordingly have snap locks 54A, 54B on the respective legs, cooperating with snap locks 48A and 48B to mount the nosing 38 to outer panel 44 of jamb plate 36.

Legs 52A and 52B extend outwardly from studs 46A and 46B and away from the building and are connected at spaced locations of the legs to a front panel 56 of the nosing. Front panel 56 extends transversely of the jamb plate main panel, and follows a direction generally corresponding to the direction of extension of outer panel 44 of the jamb plate. Front panel 56 is typically displaced from the outer surface of the substrate, and thus from the outer panel of the jamb plate, by a distance corresponding to a typical thickness of brick mold or the like. Accordingly, while spacing between the outer surface of the substrate and the front panel of the jamb plate can, in some instances, be a nominal distance, the typical application of the nosing is directed toward replacing the typical e.g. brick mold type or like trim around a door frame. Thus, typical distances between the outer surface of the substrate and the outer surface of the front panel are about 0.5 inch to about 1.5 inches, preferably about 0.6 inch to about 1.25 inches, even more preferably about 1 inch to about 1.13 inches.

As illustrated in FIGS. 2–4, front panel 56 can and typically does deviate to an extent from a true reproduction of the direction of extension of the front panel of the jamb plate, and thus can define a non-planar surface profile, or an interrupted planar surface profile, or a partially planar surface profile, of the nosing which nonetheless extends generally along, and displaced from, the outer surface of the outer panel of the jamb plate. FIG. 3 shows a profile generally corresponding with commonly known window trim profiles. FIG. 4 shows the profile generally known as a brick mold profile, and shows a brick 55 representatively shown located adjacent the brick mold.

As seen in FIGS. 2–4, front panel 56 extends away from legs 52A and 52B, away from main side panel 42 of the jamb plate, to a distal side 58 of the nosing. A nailing fin kerf 60 is built into either the jamb plate or the nosing. In general, the nailing fin kerf can be located in a region which extends from proximate the distal side of the nosing to proximate studs 46A and 46B of the outer panel of the jamb plate. In FIGS. 2–4, the nailing fin kerf is located at distal side 58 of the nosing, nailing fin 20 being mounted in kerf 60. In the embodiments illustrated in FIGS. 2–4, nailing fin kerf 60 is located at the distal side of the nosing, whereby nailing fin 20 extends outwardly from the distal side of the combination of the nosing and the jamb plate. In the embodiments shown, the nailing fin kerf is built into the distal side of the nosing. The nailing fin kerf can be located inwardly of the distal side of the nosing, more toward leg 52A. Typically, the outer panel of the jamb plate, and thus the entire jamb plate, is devoid of any nailing fin kerf. However, in some less preferred embodiments, the nailing fin kerf can be an element of the outer panel of the jamb plate, generally proximate outer stud 46A. Wherever the nailing fin kerf, the nailing fin, itself, must extend outwardly of the side edge of the nosing so that the nailing fin can be secured to framing members of the building, thereby securing the frame to the building while the nosing is assembled to the outer panel of the jamb plate.

A wide variety of mounting structures are contemplated for joining jamb plate 36 and nosing 38 to each other as a two-component iamb cover assembly, with optional addition of the mounting fin to the two-component jamb cover assembly, whereby locks 48A, 48B, 54A, 54B are merely exemplary of such mounting structures.

While two nosing structures are illustrated in FIGS. 2–4, the nosings illustrated are merely exemplary of a wide variety of nosing structures which can be employed in the invention.

As illustrated in FIGS. 3 and 4, the jamb cover assembly 34 is secured to the jamb substrate e.g. at side surface 32 by screws, nails, or like fasteners 62. The jamb cover assembly can also be secured to the jamb substrate at other locations such as at outer surface 30 of the jamb substrate (securement not shown). The nosing is mounted to the jamb plate by the mounting structures represented by locks 48A, 48B, 54A, 54B. Nosing 38 is in turn secured to a building frame member 27 by screws, nails or like fasteners 62 through nailing fin 20.

By providing the jamb plate, the nosing, and the nailing fin as separate and distinct jamb cover elements, as illustrated especially in FIGS. 3 and 4, a wide variety of framing needs can be satisfied with a limited inventory of such cover elements.

Whereas prior art jamb cover assemblies require securing the nailing fin to the building framing member under the nosing, which requires that the nosing be assembled to the jamb plate after field installation of the frame in the rough opening at the building site; by positioning the nailing fin such that the nailing fin extends outwardly from the distal side of the jamb cover assembly in the invention, the jamb cover assembly members, including the nosing, can all be mounted, directly or indirectly, to the frame substrate elements of the door frame assembly, in an off site manufacturing facility, whereby no frame assembly need be accomplished at the building site.

Accordingly, the door frame can be shipped to the building site fully assembled. The nosing need not be shipped separately, thereby obviating any risk of losing the nosing in transit, or forgetting to put the nosing on the truck with the door frame. Similarly, the nosing need not be assembled to the frame at the building site.

Jamb plate 36 and nosing 38 are preferably metal extrusions, such as aluminum extrusions wherein the respective profile elements of the extrusions have profile thicknesses "T" of about 0.04 inch to about 0.07 inch, with preferred thicknesses of about 0.06 inch. A highly preferred thickness is about 0.062 inch.

As illustrated in FIGS. 2–4, the nailing fin includes a hinge 66 which facilitates articulating or deflecting the nailing fin from its mounting position, wherein the nailing fin extends transverse to and away from both legs 46 and parallel to the outer panel (FIGS. 3–4), toward the main side panel of the iamb plate and/or substrate element 28 by about 90 degrees or more, illustrated in dashed outline in FIG. 2, e.g. for shipping the door frame, and erecting the nailing fin as illustrated in solid outline in FIG. 2 for attaching the door frame to a building.

Figure 5:
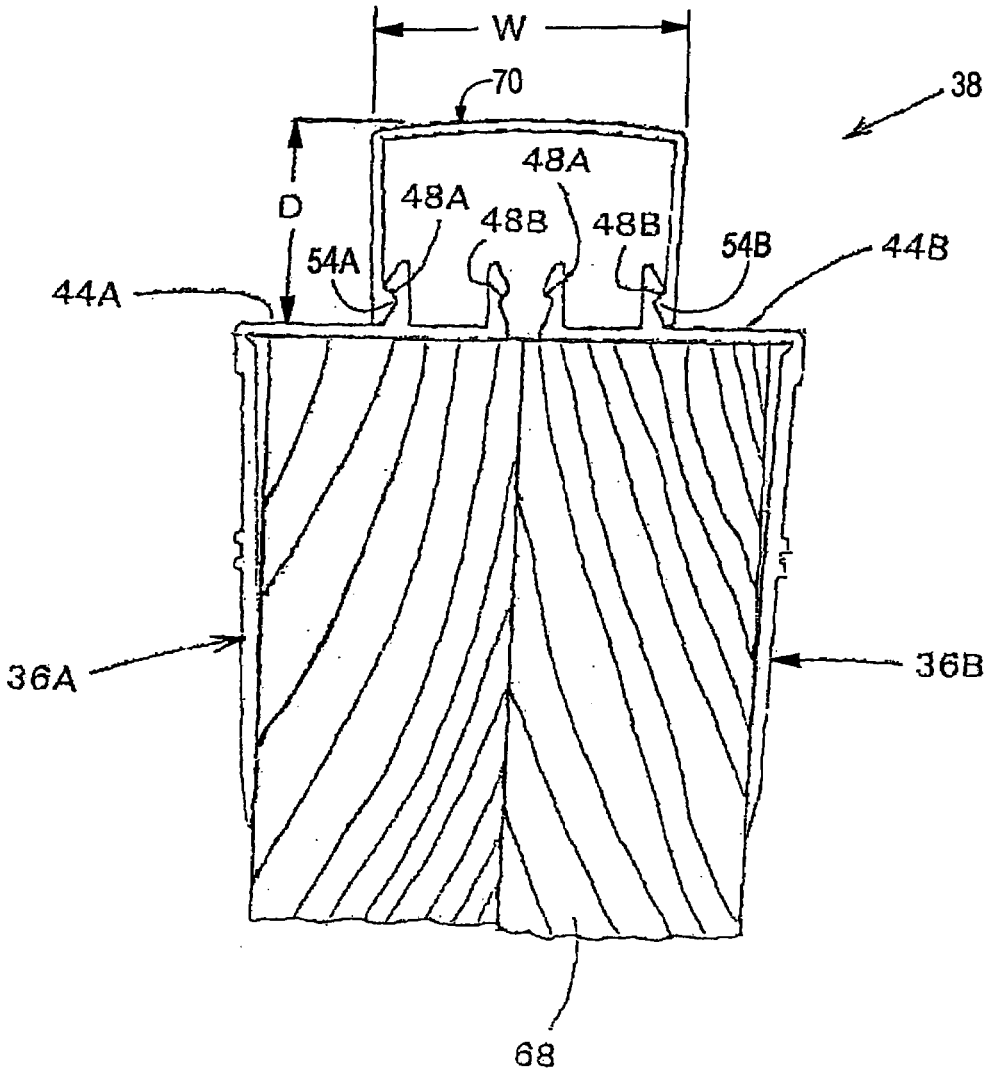
FIG. 5 shows a mullion covered on opposing side surface by first and second jamb plates of the invention, and a special mullion nosing cover of the invention mounted to the jamb plates and bridging the jamb plates, thereby to provide a unitary appearance to the face of the mullion while protecting the mullion from the outside environment.

FIG. 5 shows the principles of the jamb cover assembly, including first and second separate and distinct jamb plates 36A and 36B, and a nosing 38, applied to a mullion substrate 68 adjacent a door opening, as a mullion cover assembly. Such mullion cover assembly can be used, for example, with the combination of a door frame and a side light, or between glass panes in a window or window cluster. As shown in FIG. 5, first and second jamb plates 36A, 36B, as used in the previous embodiments as part of a door frame, have respective first and second main side panels and first and second outer panels. First locking loci 48A, 48B are defined on e.g. the outer panel of the left jamb plate; and second locking loci 48A, 48B are defined on e.g. the outer panel of the right jamb plate. Third and fourth locking loci are defined on legs of mullion nosing 70, which legs correspond to legs 52A, 52B of nosing 38 which is illustrated in FIG. 2. The first and second jamb plates are positioned on opposing side surfaces of the mullion substrate. The main side surfaces of the jamb plates cover respective side surfaces of the mullion substrate.

Outer panels 44A, 44B of the respective jamb plates generally reside in a common plane with respect to each other as shown, and partially cover the outer surface of the mullion substrate 68, optionally leaving a portion of the mullion substrate uncovered as shown in FIG. 5. A special mullion nosing 70 bridges the jamb plates, and third and fourth locking loci on the nosing snap lock respective first and second locking loci 48A, 48B on the jamb plates, thereby locking together the combination of the mullion nosing and the two jamb plates.

The mullion nosing extends outwardly from the outer panels and locking studs of the jamb plates, preferably a distance "D" consistent with the distance "D" on the nosings of corresponding door jamb cover assemblies, such that the distance "D" of extension of the nosing from the jamb plates, at the mullion cover, is the same distance "D" of extension of the nosings from the jamb plates at the door frames, whereby the nosings will present a common depth appearance about the entirety of the door area.

Mullion nosing 70 is merely a further illustration of the wide variety of nosing structures which can be attached to jamb plates 36. The width "W" of the mullion nosing can be selected according to the width of the mullion substrate to which the mullion cover assembly is to be assembled, in combination with the dimensions of the jamb plates with which the mullion nosing is to be used. The width "W", of any of the nosings 38 used with jamb cover assemblies 34, can be selected based on a variety of considerations including, without limitation, aesthetic appeal, and availability of a building framing member to receive nailing fin 20 beyond the distal side of the nosing.

The jamb and mullion cover assemblies of this invention are well suited to provide protective covering for e.g. wood, plastic, or other substrates useful in fabricating door frames, mullions, and the like. Thus, in typical application, the frame or mullion is fabricated by a frame or mullion fabricator, and shipped to a door assembler. The door assembler receives the frame as fabricated, and assembles the frames to door slabs, which are also commonly purchased separately. The door assembler adds the desired glass inset, if any, to the door slab, as needed, and assembles the door slab to a selected door frame. Typically, the basic frame is wood.

The door assembler can easily up-grade the quality and value of the door and frame by installing jamb cover assemblies of the invention to the left, right, and top frame substrate members, thus to provide a maintenance free, tough, and durable exterior surface to the frame. Mullions can be up-graded in the same manner. The thus up-graded frame and/or mullion is shipped to the builder at the building site. The builder installs the frame, with or without the door slab, in the respective rough opening in the building. If the door slab is not installed with the frame, the door slab can be installed at another time.

By designing and configuring the jamb cover assemblies of the invention with the nailing fin extending outwardly from the nosing, the on-site installation to the building can be done without removing the nosing from the jamb cover assembly. By corollary, the jamb cover assembly can be installed without the need to install the nosing to the jamb plate at the building site. Since all such assembly can be accomplished at the off-site manufacturing facility, relatively tighter tolerances can be used, assembly errors can be better controlled, and assembly damage can be better controlled or reduced, as compared to on-site assembly operations. Thus, where cover assemblies of the invention are used in constructing new buildings, the invention provides improved quality control to the process of installing door frames and mullions in the buildings.

Overall, the cover assemblies of the invention produce frames which are known as "cladded" products. Namely, typical frame materials are "cladded" with the cover assemblies of the invention in order to up-grade the value of the resulting product.

In an alternative use of jamb cover assemblies and mullion cover assemblies of the invention, the cover assemblies are installed to the jamb substrates or the mullion substrates at the building site. Such on-site installation can be used e.g. where no local door assembler provides the cladding service. In addition, such on-site installation of the cladding elements can be used to up-grade an existing building, or an existing door frame and/or mullion in an existing building. In such case, the cladding elements, namely the iamb plates and nosings are installed on the jamb and/or mullion at the building site as add-on components of the respective frame or mullion. In the instance of the existing building, use of the nailing fin is obviated.

It should be noted that, while the above embodiments, such as at FIG. 1, have suggested use of the invention with personnel doors, the invention can be used with doors of practically any size. Thus, the inventor contemplates use of the invention on, for example and without limitation, garage doors, doors at truck shipping docks, double personnel doors, Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. An elongate nosing assembly for mounting to an elongate jamb plate, wherein such elongate jamb plate is designed and configured to be mounted on an elongate jamb substrate of a door frame, wherein such elongate jamb plate comprises a main side panel, and at least one outer panel, such at least one outer panel being configured to extend at an angle transverse to such main side panel, and away from such main side panel, a given one such outer panel bearing a first mounting structure having first and second locks (48A, 48B), said elongate nosing assembly comprising (a) a nosing comprising second mounting structure having third and fourth locks (54A, 54B), designed and configured to cooperatively mount to such first mounting structure of such jamb plate, thereby to mount said nosing to such jamb plate; and (b) a mounting fin mounted to said nosing, and wherein said mounting fin is adapted to be articulated toward such main side panel of such jamb plate, and into proximity with a such jamb substrate when said elongate nosing assembly is mounted to a such jamb plate which is mounted to a such jamb substrate, said elongate nosing assembly being a two-component assembly comprising said nosing, as a single-piece nosing, and said mounting fin.

2. An elongate nosing assembly as in claim 1, said mounting fin comprising a polymeric mounting fin, said elongate nosing assembly being a two-component assembly comprising said nosing and said polymeric mounting fin.

3. An elongate nosing as in claim 1 wherein said elongate nosing comprises an aluminum extrusion having nominal profile thicknesses of about 0.06 inch.

4. A nosing assembly as in claim 1 wherein said nosing comprises a brickmold nosing.

5. A nosing assembly as in claim 1 wherein said nosing extends outwardly, away from said main panel, in a direction comprising substantially an extension of said outer panel, and beyond the distal edge of said outer panel.

6. An elongate nosing assembly as in claim 1, said second mounting structure being defined by first and second legs extending in a common direction toward such first mounting structure.

7. An elongate nosing assembly as in claim 1, said nosing comprising a front panel (56), said second mounting structure (54A, 54B) being disposed between said front panel and such outer panel of such jamb plate.

8. A mullion cover assembly, comprising:

(a) a first elongate jamb plate comprising a first main side panel, a first outer panel extending at an angle transverse to said first main side panel, said first outer panel comprising a first mounting structure which defines a first locking locus corresponding to a first lateral location along a first width of said first outer panel;

(b) as a separate and distinct element, a second elongate jamb plate comprising a second main side panel, a second Outer panel extending at an angle transverse to said second main side panel, said second outer panel comprising a second mounting structure which defines a second locking locus corresponding to a second lateral location along a second width of said second outer panel, said first and second outer panels, when said first and second elongate jamb plates are mounted to first and second side surfaces of a mullion substrate, generally residing in a common plane with respect to each other; and (c) an elongate nosing comprising a third mounting structure which defines third and fourth locking loci corresponding to third and fourth lateral locations along a third width (W) of said elongate nosing, said third and fourth locking loci on said nosing being engageable with said first and second locking loci on said first and second jamb plates thereby to mount said nosing to said first and second jamb plates such that said nosing bridges said jamb plates, and locks together the combination of said nosing and said first and second jamb plates, the distance between the third and fourth loci being at least as great as the sum of any extensions of said first and second outer panels, beyond said first and second locking loci, away from the respective said first and second main side panels.

9. A mullion cover assembly as in claim 8, said nosing comprising a front panel spaced from said outer panels of said first and second jamb plates.

10. A mullion cover assembly as in claim 8 wherein said jamb plates said nosing comprise aluminum extrusions.

11. A mullion cover assembly as in claim 10 wherein said aluminum extrusions have nominal profile thicknesses of about 0.06 inch.

12. A mullion cover assembly as in claim 8 wherein said first and second outer panels are spaced from each other when said mullion cover is mounted on a mullion substrate, with said nosing snap-locked to said first and second elongate jamb plates, thereby to leave a portion of an outer surface of such mullion substrate uncovered, as an uncovered space between said first and second outer panels, and wherein said nosing bridges such uncovered space thereby to complete the coverage of such outer surface of such mullion substrate.

13. A mullion assembly, comprising:

(a) a mullion substrate having a length, first and second opposing side surfaces facing in opposing directions, generally along an outer surface of a building when said mullion assembly is installed on such building, and an outer surface facing outwardly from such outer surface of such building when said mullion assembly is installed on such building;

(b) a first elongate jamb plate comprising a first main side panel extending along at least a portion of the first side surface of said mullion substrate, said first elongate jamb plate further comprising a first outer panel extending at an angle transverse to said first main side panel, said first outer panel facing away from such building and comprising a first mounting structure;

(c) a second elongate jamb plate comprising a second main side panel extending along at least a portion of the second side surface of said mullion substrate, said second elongate jamb plate further comprising a second outer panel extending at an angle transverse to said second main side panel, said second outer panel facing away from such building and comprising a second mounting structure; and (d) an elongate nosing comprising a third mounting structure engaged with said first and second mounting structures on said first and second outer panels of said first and second jamb plates and thereby mounting said nosing to said first and second jamb plates at said first and second outer panels, wherein said first and second outer panels of the respective said first and second jamb plates are in surface-to-surface relationship with the outer surface of said mullion substrate.

14. A jamb cover assembly comprising an elongate jamb plate having a first length and an elongate nosing having a second length, and joined to said jamb plate, said jamb plate comprising a two-panel jamb plate having (a) a main side panel, and (b) an outer panel extending from a locus of joinder with said main side panel, at an angle transverse to said main side panel, to a distal edge of said outer panel, said elongate nosing extending in a straight line path along a substantial portion of the first length of said jamb plate and consisting of a single unitary structure, said jamb plate and said nosing collectively comprising mounting structure whereby said jamb plate and said nosing are mounted to each other through mounting structure communicating with said outer panel of said jamb plate, further comprising a mounting fin kerf in said nosing, located outwardly of the distal edge of said outer panel, such that the distal edge of said outer panel is disposed generally between said mounting fin kerf and said main side panel, said mounting fin kerf defining an opening, facing away from said outer panel, and configured to receive a mounting fin thereinto.

15. A jamb cover assembly as in claim 14, further comprising a mounting fin in said mounting fin kerf.

16. A jamb cover assembly as in claim 14 wherein said elongate nosing comprises a brick mold nosing which is defined, along the second length, by a unitary cross-section profile.

17. A jamb cover assembly as in claim 15 wherein said elongate nosing comprises a brick mold nosing which is defined, along the second length, by a unitary cross-section profile.

18. A jamb cover assembly as in claim 15 wherein said mounting fin is adapted to be articulated toward said main side panel and into proximity with a jamb substrate.

19. A door frame having a left frame element, a right frame element, and a top frame element, each of said left frame element, said right frame element, and said top frame element comprising a jamb cover assembly as in claim 14.

20. A method of up-grading an existing door frame which defines a doorway opening and which has been previously installed in an existing building, such existing door frame comprising a main jamb surface which faces into the doorway opening, a first outer jamb surface which faces a first direction away from the doorway opening, and a second outer jamb surface which faces a second opposing direction away from the doorway opening, the method comprising installing extruded aluminum cladding elements over the main surface and one of the outer jamb surfaces while the door frame is installed in the building, the extruded aluminum cladding elements which are installed on a given such jamb element comprising an elongate extruded aluminum jamb plate having a first length, and an elongate extruded aluminum nosing having a second length, the method including joining the extruded aluminum nosing to the extruded aluminum jamb plate as part of the up-grading, the jamb plate, which is installed on a given such jamb element having (a) a main side panel, and (b) an outer panel extending from a locus of joinder with the main side panel, at an angle transverse to the main side panel, the elongate nosing, which is installed on the given jamb plate extending in a straight line path and consisting of a single unitary structure, the jamb plate and the nosing collectively comprising mounting structure whereby the jamb plate and the nosing are mounted to each other through mounting structure communicating with the outer panel of the jamb plate adjacent only one of the first and second outer jamb surfaces, further comprising a mounting fin kerf in the given nosing, located outwardly of the distal edge of the outer panel, such that the distal edge of the outer panel is disposed generally between the mounting fin kerf and the main side panel.

21. A method as in claim 20, the nosing comprising a front panel (56), the second mounting structure (54A, 54B) being disposed between the front panel and the outer panel of the jamb plate.

22. In combination, an elongate nosing assembly and an elongate jamb plate, said elongate jamb plate being designed and configured to be mounted on an elongate jamb substrate of a door frame, said elongate jamb plate comprising a main side panel, and a first outer panel, extending at an angle transverse to said main side panel, and away from said main side panel, a first mounting structure comprising first and second locks, said first and second locks being connected to and extending away from said first outer panel in a common direction, said elongate nosing assembly comprising (a) a nosing comprising second mounting structure, designed and configured to cooperatively mount to said first mounting structure, thereby to mount said nosing to said jamb plate, said nosing, when mounted to said jamb plate, extending away from said main side panel; and (b) as a separate and distinct element, a mounting fin adapted to be mounted to said nosing, said mounting fin, when interfacing with a building to mount said mounting fin thereto, extending generally parallel to said outer panel, said mounting fin being deflectable, from a mounting position extending generally parallel to said outer panel, toward said main side panel of said jamb plate by about 90 degrees or more, said elongate nosing assembly being a two-component assembly comprising said nosing, as a single-piece nosing, and said mounting fin.

23. A combination as in claim 22, said second mounting structure being defined by first and second legs extending in a common direction toward such first mounting structure.

24. A combination as in claim 22, said nosing comprising a front panel (56), said second mounting structure (54A, 54B) being disposed between said front panel and said outer panel of said jamb plate.

25. A jamb cover assembly, comprising:

(a) an elongate jamb plate adapted and configured to interface with a doorway substrate, and comprising a main side panel, and an outer panel extending from a locus of joinder with said main side panel, said elongate jamb plate comprising first mounting structure extending from said outer panel, and (b) an elongate nosing assembly comprising (i)an elongate nosing comprising a front panel (56), and second mounting structure, comprising at least first and second legs, disposed between said front panel of said nosing and said outer panel of said jamb plate, said outer panel, when said jamb cover is mounted in a doorway of a building, being disposed between at least one of said legs and such substrate, and (ii) as a separate and distinct element, a mounting fin adapted to be mounted to said nosing, said mounting fin being deflectable, from a mounting position extending generally parallel to said outer panel, toward said main side panel of said jamb plate, by about 90 degrees or more, said elongate nosing assembly being a 2-component assembly comprising said nosing as a single-piece nosing, and said mounting fin.

26. A jamb cover assembly as in claim 25, at least the first and second ones of said at least first and second legs extending in a common direction toward said first mounting structure.

27. A jamb cover assembly as in claim 25, said nosing comprising a front panel (56), said second mounting structure (54A, 54B) being disposed between said front panel and said outer panel of said jamb plate.

28. A jamb cover assembly, adapted and configured to be mounted to a substrate in a doorway of a building, such substrate generally having a main surface facing across such doorway, and a first outer surface facing away from such building, said jamb cover assembly comprising:

(a) an elongate jamb plate, comprising (i) a main side panel, (ii) a first outer panel extending from a locus of joinder with said main side panel, and (iii) first mounting structure, comprising first and second locks on said first outer panel, said first and second locks being proximate a common face of such substrate;

(b) a nosing comprising second mounting structure, cooperatively mounting to said first mounting structure, thereby mounting said nosing to said jamb plate; and (c) as a separate and distinct element, a mounting fin adapted to be mounted to said nosing, said mounting fin being deflectable toward said main side panel of said jamb plate by about 90 degrees or more, said elongate nosing assembly being a 2-component assembly comprising said nosing, as a single-piece nosing, and said mounting fin.

29. A jamb cover assembly as in claim 28, said second mounting structure being defined by first and second legs extending in a common direction toward such first mounting structure.

30. A jamb cover assembly as in claim 28, said nosing comprising a front panel (56), said second mounting structure (54A, 54B) being disposed between said front panel and said outer panel of said jamb plate.

31. A jamb cover assembly comprising an elongate jamb plate having a first length and an elongate nosing having a second length, and joined to said jamb plate, said jamb plate consisting of a single unitary structure, said jamb plate having (a) a main side panel portion, and (b) an outer panel portion extending from a locus of joinder with said main side panel portion, at an angle transverse to said main side panel portion, to a distal edge of said outer panel portion, said elongate nosing extending in a straight line path along a substantial portion of the first length of said jamb plate and consisting of a single unitary structure, said jamb plate and said nosing collectively comprising mounting structure whereby said jamb plate and said nosing are mounted to each other through mounting structure communicating with said outer panel portion of said jamb plate, further comprising a mounting fin kerf in said nosing, located outwardly of the distal edge of said outer panel, such that the distal edge of said outer panel is disposed generally between said mounting fin kerf and said main side panel, said mounting fin kerf defining an opening, facing away from said outer panel, the opening being configured to receive a mounting fin thereinto.

* * * * *